US006571888B2

(12) United States Patent
Comeau et al.

(10) Patent No.: US 6,571,888 B2
(45) Date of Patent: Jun. 3, 2003

(54) APPARATUS AND METHOD FOR DIRECTIONAL DRILLING WITH COILED TUBING

(75) Inventors: Laurier E. Comeau, Leduc (CA); Ian G. Gillis, Leduc (CA); Craig J. Knull, Edmonton (CA)

(73) Assignee: Precision Drilling Technology Services Group, Inc., Calgary (CA)

( * ) Notice: Subject to any disclaimer, the term of this patent is extended or adjusted under 35 U.S.C. 154(b) by 0 days.

(21) Appl. No.: 09/853,686

(22) Filed: May 14, 2001

(65) Prior Publication Data

US 2002/0166701 A1 Nov. 14, 2002

(51) Int. Cl.[7] ..... E21B 7/04; E21B 7/08

(52) U.S. Cl. ..... 175/61; 175/74; 175/45; 175/95; 175/107; 175/73

(58) Field of Search ..... 175/61, 74, 107, 175/45, 38, 73, 95, 256

(56) References Cited

U.S. PATENT DOCUMENTS

| | | | | |
|---|---|---|---|---|
| 3,586,116 A | * | 6/1971 | Tiraspolsky et al. | 175/256 |
| 4,760,759 A | | 8/1988 | Blake | |
| 5,113,953 A | * | 5/1992 | Noble | 175/61 |
| 5,215,151 A | | 6/1993 | Smith et al. | |
| 5,311,952 A | | 5/1994 | Eddison et al. | |
| 5,332,048 A | | 7/1994 | Underwood et al. | |
| 5,535,835 A | | 7/1996 | Walker | |
| 5,538,091 A | | 7/1996 | Theocharopoulos | |
| 5,547,031 A | | 8/1996 | Warren et al. | |
| 5,617,926 A | * | 4/1997 | Eddison et al. | 175/61 |
| 5,636,178 A | | 6/1997 | Ritter | |
| 5,831,177 A | | 11/1998 | Waid et al. | |
| RE36,556 E | | 2/2000 | Smith et al. | |
| 6,129,160 A | * | 10/2000 | Williams et al. | 175/107 |
| 6,158,529 A | | 12/2000 | Dorel | |
| 6,216,802 B1 | * | 4/2001 | Sawyer | 175/61 |
| 6,415,878 B1 | * | 7/2002 | Cargill et al. | 175/61 |
| 6,419,014 B1 | * | 7/2002 | Meek et al. | 166/255.2 |

FOREIGN PATENT DOCUMENTS

| | | |
|---|---|---|
| CA | 2079071 | 6/1996 |
| CA | 2234495 | 10/1999 |
| WO | WO 93/10326 | 5/1993 |
| WO | WO 97/16622 | 5/1997 |

OTHER PUBLICATIONS

Greener, Transatlantic Sunergy Helps Drill Better Horizontal Holes, Hart's Petroleum Engineer International, Aug. 1998, pp. 37, 40, vol. 71.

Anonymous, Economic Advantages of a New Straight–Hole Drilling Device, Journal of Petroleum Technology, Dec. 1999, pp. 26, 35, vol. 51.

Elsborg et al., High Penetration Rate Drilling with Coiled Tubing, Profit through synergy: proceedings of the 2. international three–day conference and trade show on horizontal well technology, Nov. 18–20, 1996, pp. 333–343.

(List continued on next page.)

*Primary Examiner*—William Neuder
*Assistant Examiner*—Thomas Bomar
(74) *Attorney, Agent, or Firm*—Sean W Goodwin

(57) ABSTRACT

An improved coiled tubing directional drilling method comprises: providing a bent housing which is rotatably coupled to the coiled tubing, rotating the drill bit, and rotating the bent housing. Apparatus for achieving the method comprises: a rotary connection between the coiled tubing and the bent housing and means for rotating the bent housing relative to the coiled tubing and to the drill bit. A fluid pressure-operated clutch enables alternate rotation and locking of the bent housing. Preferably, a first downhole motor rotates the drill bit and a second downhole motor rotates the bent housing through the clutch or alternately a speed reducer permits the bent housing to contra-rotate slowly under reactive torque developed by the rotating drilling bit.

17 Claims, 12 Drawing Sheets

OTHER PUBLICATIONS http://www.rotarysteerable.com/product.htm print date: Feb. 20, 2001,.

http://www.halliburton.com/sperry–sun/services/drill/extend.asp print date: Feb. 20, 2001.

Drilling Contractor, Advanced BHAs extend capability, boost efficiency, Jan./Feb. 2001, pp. 28–30.

Drilling Contractor, Drilling equipment: Improvements from data recording to slim hole, Mar./Apr. 2000, pp. 30–32.

Derkach, High–torque gear reducer expands turbodrill capabilities, Oil and Gas Journal, Jul. 5, 1999 (at http://www.findarticles.com/cf_0/m3112/27_97/55221538/print.jhtml print date Feb. 28, 2001).

Drilling Contractor, Directional drilling: Improving efficiency and control, Mar./Apr. 2000, pp. 44, 46.

Rigden et al. New tool that will improve coiled tubing directional drilling, $4^{th}$ Intl Conf & Exhib on Coiled Tubing Tech Operations Services Practices; Houston Texas; Mar. 1996, pp 1–6.

* cited by examiner-

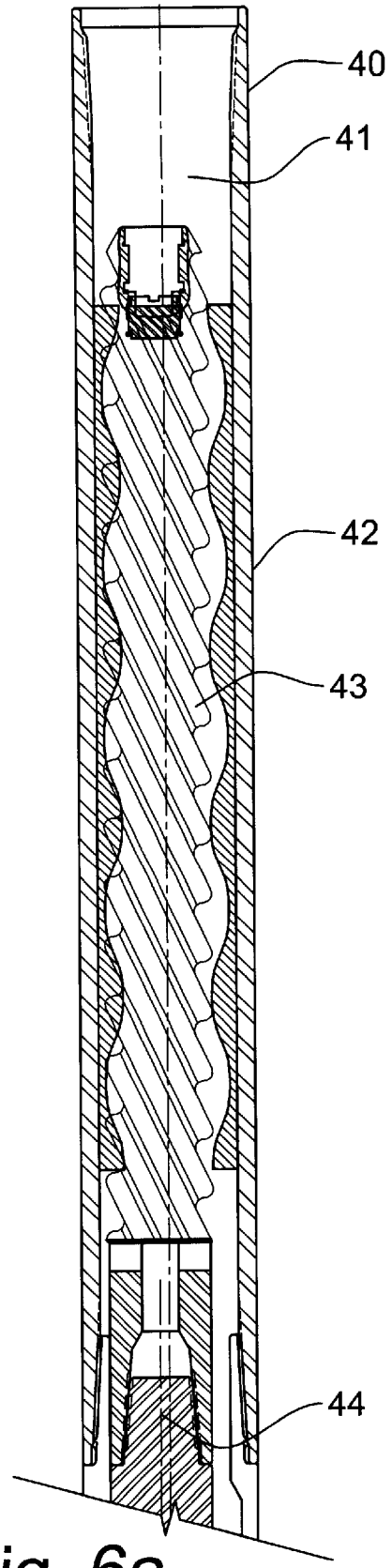
Fig. 6a
Fig. 6b
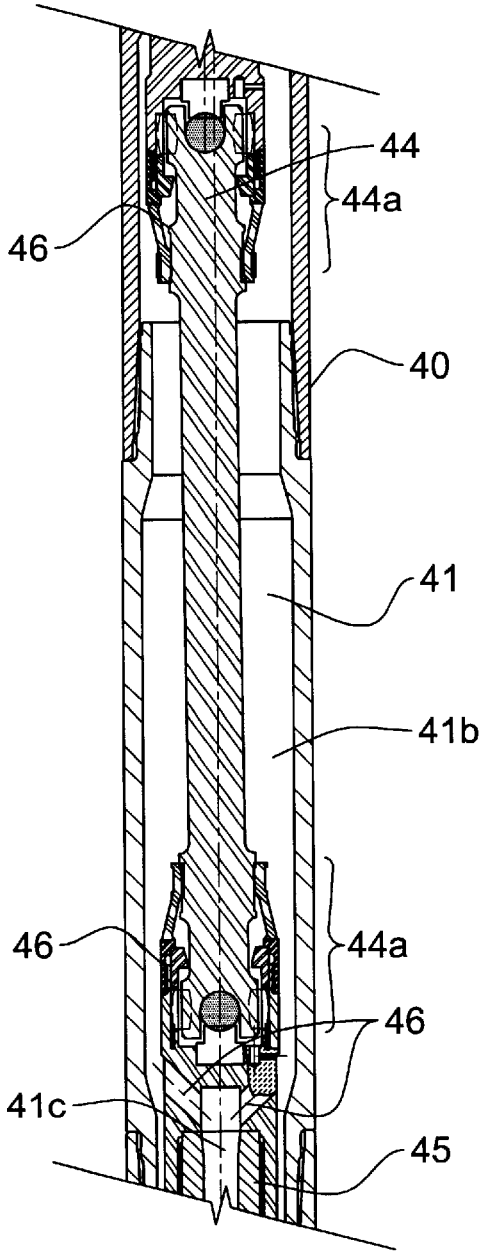

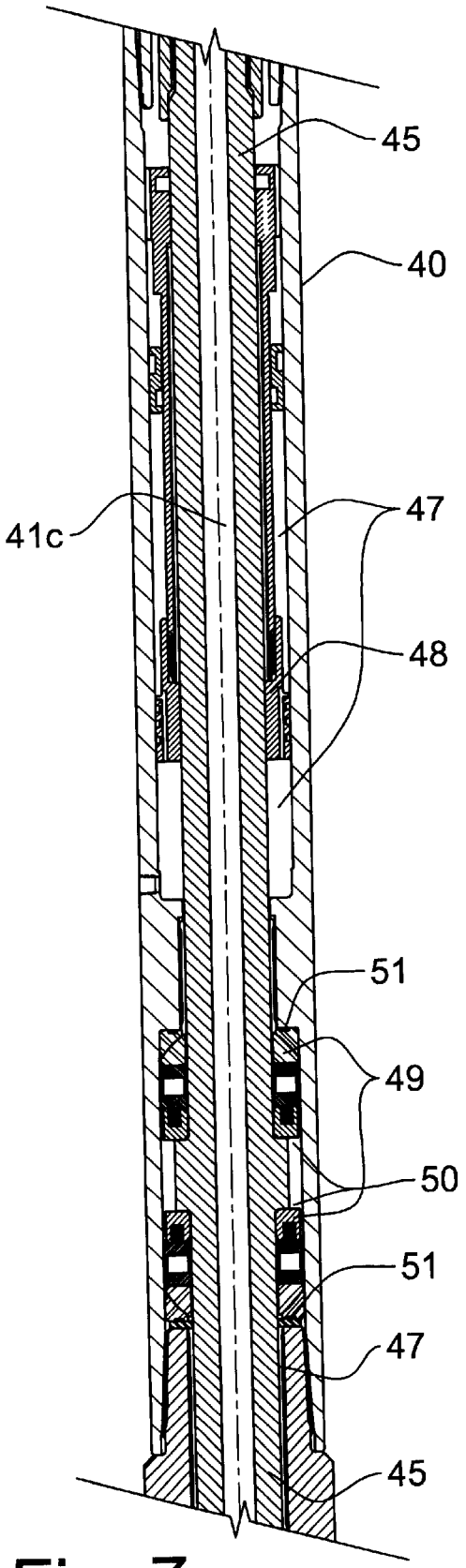
Fig. 7a
Fig. 7b
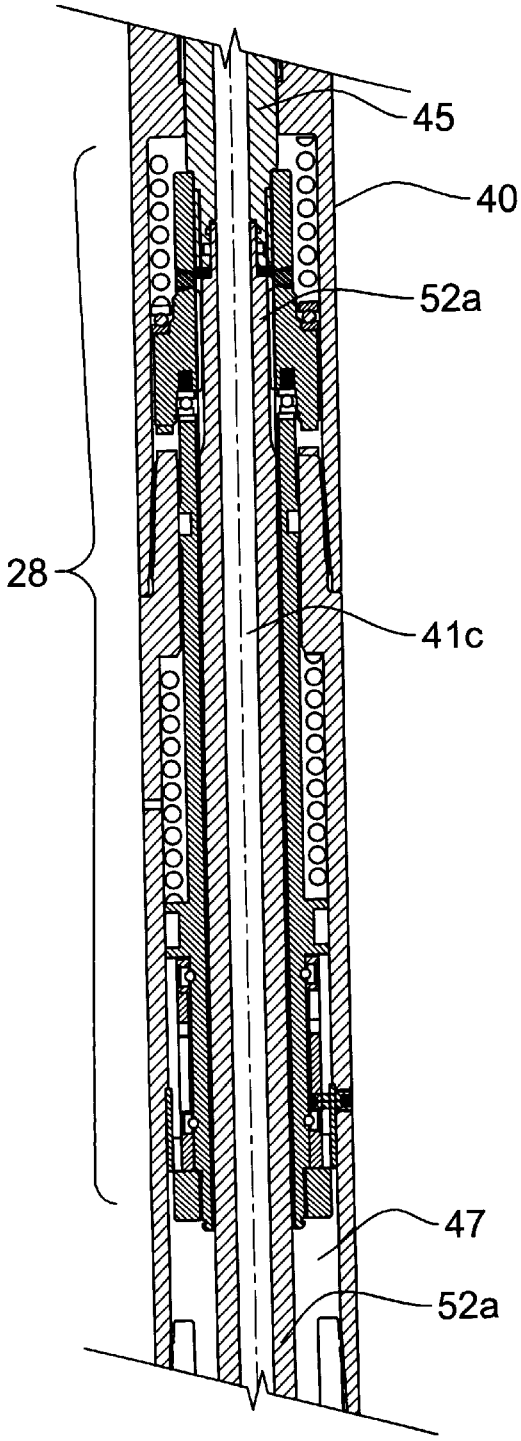

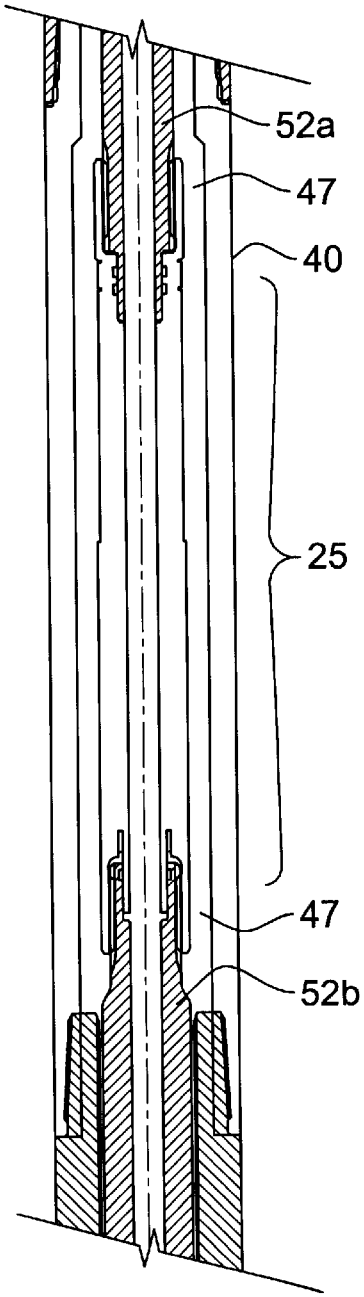
Fig. 8a
Fig. 8b
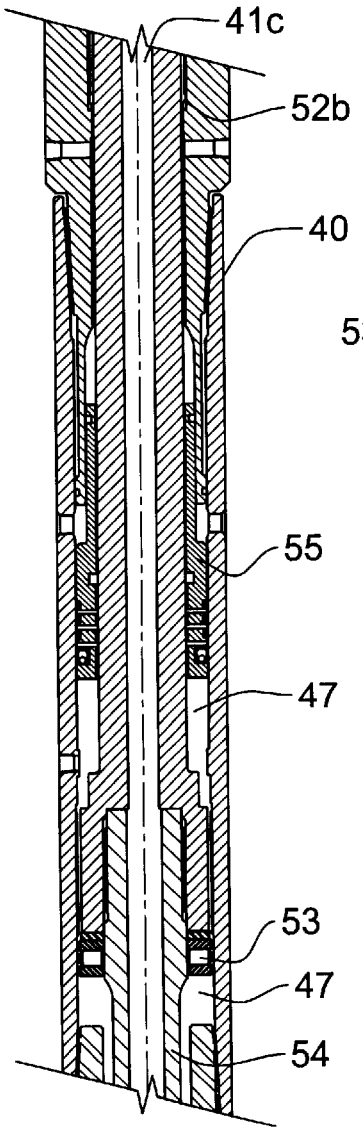
Fig. 8c
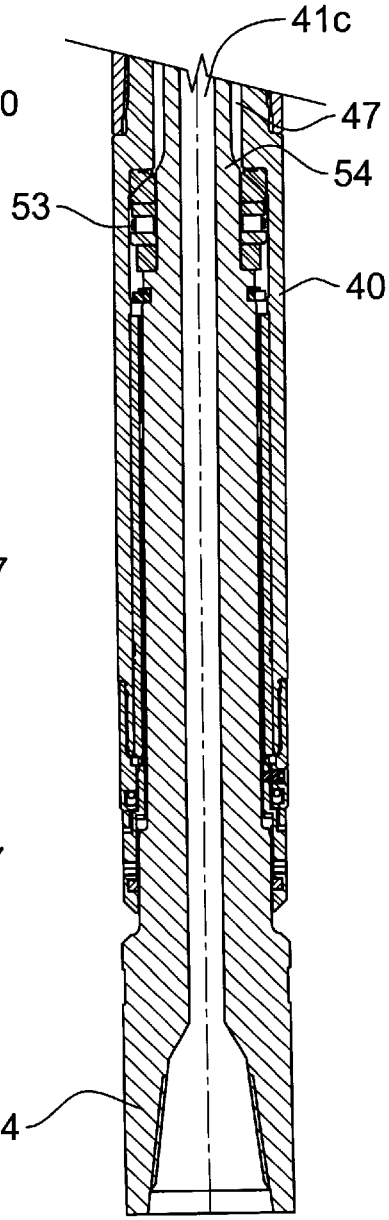

APPARATUS AND METHOD FOR DIRECTIONAL DRILLING WITH COILED TUBING

FIELD OF THE INVENTION

The present invention relates to directional drilling with coiled tubing. More particularly, bottom hole assembly apparatus including an orienting tool driven through a clutch and mud motor, a bent housing and a mud motor driving a drill bit.

BACKGROUND OF THE INVENTION

In conventional jointed tubing directional drilling, a drilling assembly, bent housing and motor are located at the downhole end of a rotary drill string. Additionally, a measurements-while-drilling (MWD) tool is used to signal drilling orientation and direction. Directional drilling is accomplished with an alternating combination of two drilling operations; a relatively short duration of steering or sliding; and a longer period of rotating. The result is a relatively continuous and curved borehole from the kick off point to the end of the curve.

More specifically, during the sliding operation, the drill string is slowly rotated to orient the bent housing in the desired direction. The mud motor is then energized so as to drill a curved path in the oriented direction. The non-rotating drill string slides along the borehole as the mud motor drills the curved path. The sliding phase is necessary for adjusting or setting the direction of the borehole path, however this phase is somewhat inefficient due to factors including: the indirect angular path, the drag of the sliding drill string, and the sole use of the mud motor. Once the desired borehole inclination is established, a rotating operation commences which uses a combination of simultaneously rotating the mud motor/drill bit and the drill string (which continuously rotates the bent housing) and which favorably results in both a higher rate of penetration (ROP) and a substantially linear path.

In conventional coiled tubing directional drilling, the coiled tubing cannot be rotated and thus is unable to implement the higher efficiency rotating operation available with jointed tubing drilling. A sliding-only operation is achieved using a bottom hole assembly (BHA) mounted at the downhole end of the coiled tubing. The BHA comprises a MWD tool, a mud motor, an orientor, a bent housing and a drill bit. The flow of mud through the coiled tubing and mud motor rotates the drill bit.

In coiled tubing directional drilling, the driller sets the build-up rate, which is a measure of increasing borehole inclination from vertical, by setting the angle of the bent housing at the surface. The angle of the bent housing, typically ½ to 3° from the axis of the tubing, sets the drill bit toolface angle. The bent housing angles are typically invariant, and once downhole, the angle is generally fixed until such time as the string is tripped-out and the angle of bent housing is changed at the surface. The orientor can be incrementally rotated while downhole to redirect the bent housing. The orientor is actuated remotely through a cycling of the pressure of the mud in the coiled tubing. Accordingly, the conventional coiled tubing directional drilling mode available to the applicant is a serpentine or tortuous path resulting from successive implementation of sliding operations; first drilling an arcuate path one direction (build) and, when so indicated by the MWD, an arcuate path in an opposing (drop) direction.

In patent application WO 97/16622 to Rigden et al., a system is disclosed which uses an upper motor which, through a pivot, rotatably drives a section of drill pipe having a bend sub and second mud motor and drill bit. The upper motor is supported from the coiled tubing. A coupling device is positioned between the upper motor and the lower drill pipe. Coupled, the upper motor rotates the lower drill pipe, bent housing and drill head resulting in straight drilling. Uncoupled, the drill head drills in the last orientation. The preferred coupling device is a flow rate controlled device positioned uphole from the upper motor. A fixed sleeve has a first port exposed to the drilling mud directed to the drill head. A second outer sleeve has a piston exposed to the mud and a resisting spring. At low mud flow rates, the force of the piston cannot over come the spring and 100% of the mud flows to the drill head for directional drilling. At higher mud rates, the force of the piston overcomes the spring and the outer sleeve slides over the first sleeve, aligning a second port in the second sleeve with the port in the first sleeve. A portion of the mud flow is redirected into an annular passage for driving the upper motor. The speed of rotation of the drill pipe is wholly controlled by mud flow, the response of the spring constant, and the variable sleeve movement. When directional drilling, reactive torque in the drill pipe is presumably fed back in to the upper motor.

In WO 93/10326 to Hallundbaek, referred to in WO 97/16622, a system using reactive torque is utilized. No upper motor is employed. Drill bit and toolface interaction results in reactive torque being transmitted along the bent sub. A pivot between the bent sub and the coiled tubing permits contra-rotation. The speed of rotation is controlled using a brake comprising a complex arrangement of a plurality of hydraulic pump devices stacked in the annulus of the swivel. Each hydraulic pump assembly comprises a radial array of small hydraulic pistons and cylinders, the pistons normally driving a circumferential cam in pump mode. In reverse, relative rotation drives the pistons and a hydraulic throttle valve restricts the hydraulic flow, braking rotation therebetween. A mud flow restriction is provided through the swivel for actuating a lock across the swivel. At higher flow rates, increased pressure drop causes the swivel to lock and enable a change of drill pipe direction. As long as flow rates are high the swivel is locked and the bent sub rotates. When the flow reduces, the lock disengages and contra-rotation and straight drilling resumes.

To date, prior art coiled tubing directional drilling apparatus and methodology are associated with certain disadvantages. In the more conventional single motor case, operations are restricted to a series of sliding-only operations, and the disadvantages associated with the resulting and typically tortuous borehole path include: reduced rate-of-penetration (ROP); toolface angle drift as a result of the reactive torque; increased borehole length; reduced weight-on-bit (WOB), further reductions in ROP, and increased likelihood of a stuck tubing string, caused by increased frictional drag. In known dual motor implementations, the variable coupling between upper motor and drill head is dependent upon maintaining specified mud flow rates. Further, the means for alternating between straight and sliding operations are either variably flow dependent or are mechanically complex, which may result in uncertain drill pipe rotation rates.

SUMMARY OF THE INVENTION

The present invention is an improved directional drilling apparatus and method for use with coiled tubing. The principle implements a BHA connected to the coiled tubing and comprises a rotary bit and a bent housing which can be rotated substantially continuously, and at will, for enabling both sliding and rotating operations, heretofore not available with coiled tubing.

In a broad aspect, a method is provided for directional drilling of non-tortuous boreholes with a coiled tubing BHA having a bent housing and a rotary drill bit, the bent housing being alternately coupled using a clutch to the coiled tubing for alternately implementing sliding operation and then rotating or straight operation by rotating the drill bit while simultaneously rotating the bent housing. The coupling comprises operation of a clutch between first and second positions, the first position for rotation of the bent housing under direct driven or reactive torque contra-rotation for straight drilling, and the second position for locking the rotation of the bent housing so as to prevent reactive rotation during sliding. Mud flow is cycled to shift the clutch between first and second positions. Subsequently, mud flow is cycled again to shift the clutch between the second and first positions. One shifted between positions, variable flow rates thereafter can be used to vary drilling characteristics in either the first or second positions without affecting the sliding or straight drilling operations. Preferably, in straight drilling, a flowmeter is also employed for providing feedback enabling monitoring of the bent housing rotation rate during straight drilling.

In a broad apparatus aspect for implementing the novel method, the apparatus comprises: a rotary connection between the coiled tubing and the bent housing. A fluid pressure-actuated clutch alternatively permits the bent housing to rotate or be locked to the coiled tubing. In one embodiment, a first downhole motor rotates the drill bit and a second downhole motor rotates the bent housing through the clutch. In another embodiment, the first downhole motor is not required, a high reduction speed reducer being positioned between the coiled tubing and bent housing so as to permit the bent housing to contra-rotate slowly under reactive torque developed by the rotating drilling bit. Preferably, an energy dissipating device or flowmeter provides control of the rate of contra-rotation.

BRIEF DESCRIPTION OF THE DRAWINGS

FIG. 2 illustrates the borehole path; FIG. 2*i* illustrates the non-rotating tubing and sliding operation; and FIG. 2*ii* illustrates the operation of rotating the tubing to drill a relatively straight borehole;

FIG. 3 illustrates the borehole path; FIG. 3*i* illustrates the non-rotating tubing and sliding operation for build; and FIG. 3*ii* for drop;

FIG. 4 illustrates the borehole path; FIG. 4*i* illustrates the non-rotating tubing, non-rotating lower sub and sliding operation; and FIG. 4*ii* illustrates the operation of rotating the lower sub to drill a relatively straight borehole;

FIGS. 6*a*–8*c* are end-to-end detailed cross-sectional views of the BHA of FIG. 5*a,* specifically from the second mud motor to which the coiled tubing is connected and down to the connection to the lower sub, the lower sub being conventional and not being detailed. More specifically:

FIG. 6*a* is a cross-sectional view of the second mud motor;

FIG. 6*b* is a cross-sectional view of the output driveshaft from the second mud motor;

FIG. 7*a* is a cross-sectional view of the pressure-balancing piston;

FIG. 7*b* is a cross-sectional view of the clutch;

FIG. 8*a* is a cross-sectional view of a generic planetary speed reducer (not detailed);

FIG. 8*b* is a cross-sectional view of the pressure-reduction piston;

FIG. 8*c* is a cross-sectional view of the bearing pack and lower sub connection;

DETAILED DESCRIPTION OF THE PREFERRED EMBODIMENT

Figures 1A, 1B, 1C:
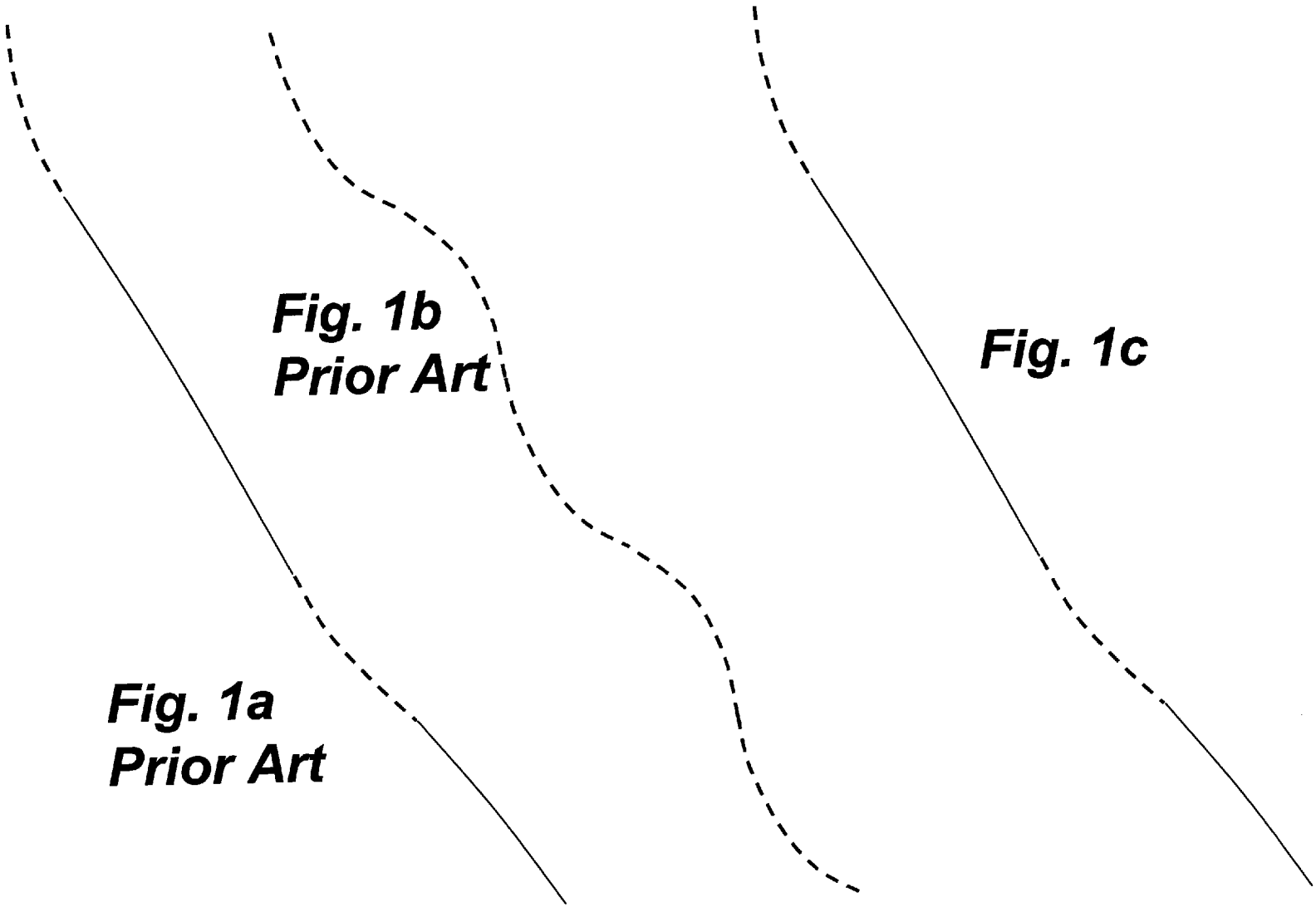
Fig. 1b Prior Art
Fig. 1a Prior Art
FIG. 1*a* is a schematic of a relatively linear borehole formed using the prior art sliding and rotation operations of conventional jointed tubing directional drilling.
FIG. 1*b* is a schematic of a borehole having a rather tortuous path formed using the prior art sliding operation of conventional coiled tubing directional drilling.
FIG. 1*c* is a schematic of a borehole formed using the present invention with coiled tubing and being far less tortuous than that shown in FIG. 1*b;*
Figures 2, 2I:
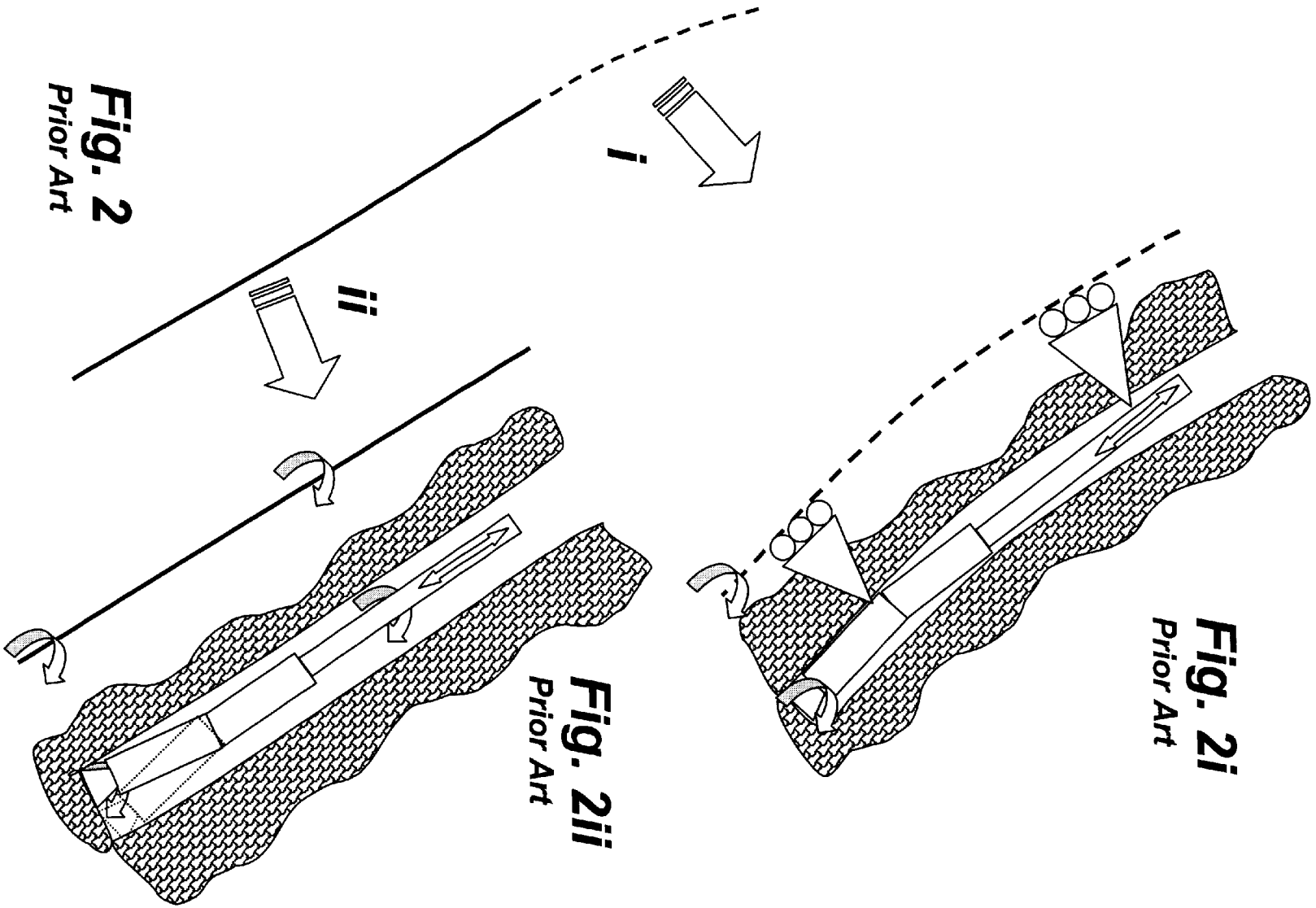
Fig. 2i Prior Art
Fig. 2ii Prior Art
Fig. 2 Prior Art
FIGS. 2–2*ii* illustrate in greater detail the apparatus and operations according to the prior art of FIG. 1*a*.

Having reference to FIGS. 1*a*, 2, 2*i* and 2*ii*, a schematic of a relatively continuous and gradual borehole is illustrated having been formed using a prior art, combined sliding (dotted lines) and rotating (continuous lines) operation of conventional jointed tubing and a mud motor. As shown in the schematic of FIG. 2*i*, the steering or sliding operation is characterized by a non-rotating tubing, non-rotating bent housing and a rotating bit. As shown in FIG. 2*ii*, the straight or rotating operation is characterized by a rotating tubing, a rotating bent housing and a rotating bit.

Figures 3, 3I:
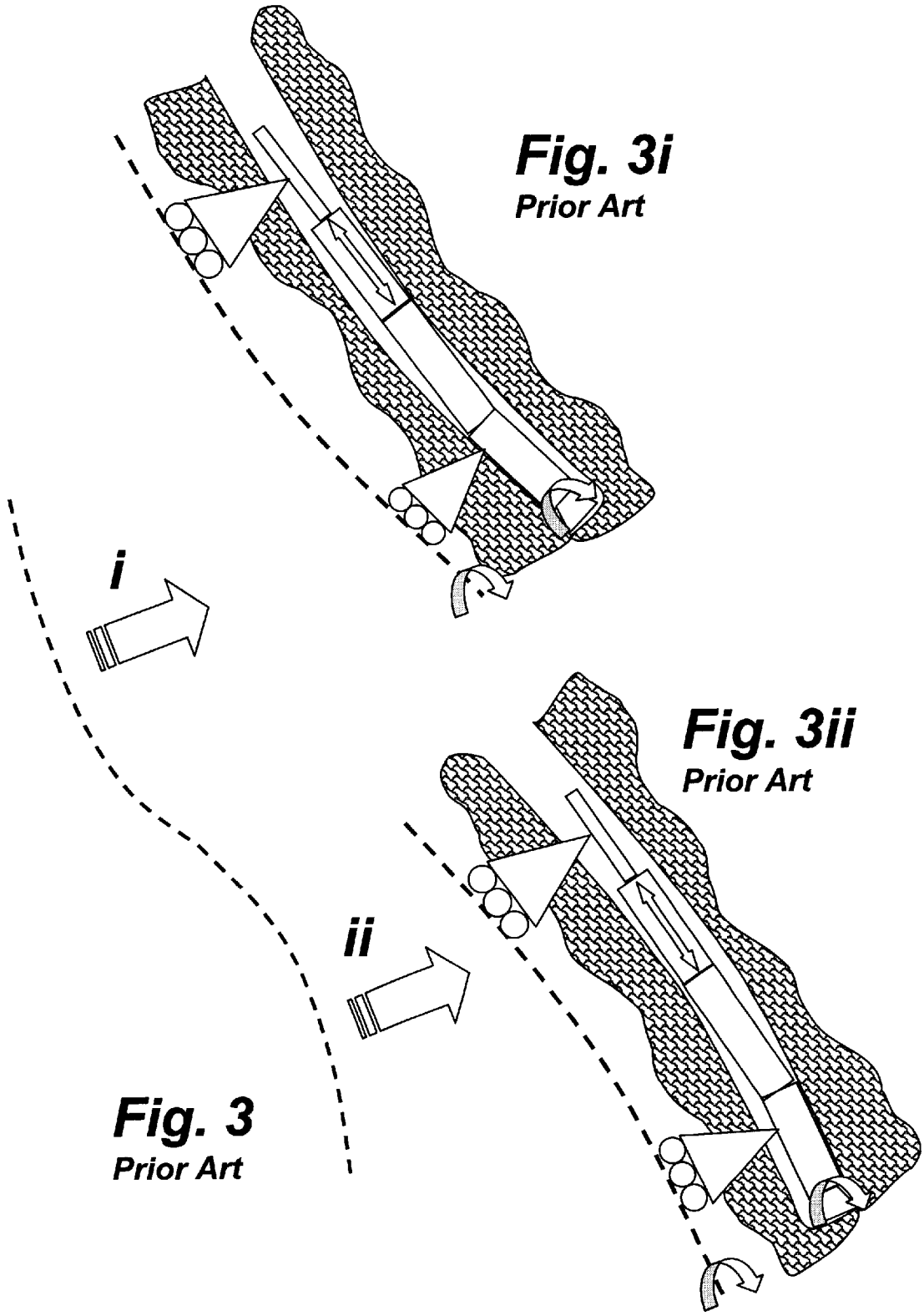
Fig. 3i Prior Art
Fig. 3ii Prior Art
Fig. 3 Prior Art
FIGS. 3–3*ii* illustrate in greater detail the apparatus and operations according to the prior art of FIG. 1*b*.

In contrast to FIG. 1*a*, FIGS. 1*b*, 3, 3*i* and 3*ii* illustrate an alternate, tortuous and inferior borehole formed using the prior art coiled tubing and single mud motor arrangement. Once again, as shown in FIG. 3*i*, the steering or sliding operation is characterized by a non-rotating tubing, a non-rotating bent housing and a rotating bit. As stated earlier, in conventional coiled tubing however, as shown in FIG. 3*ii*, there is no rotating operation.

Figures 4, 4I:
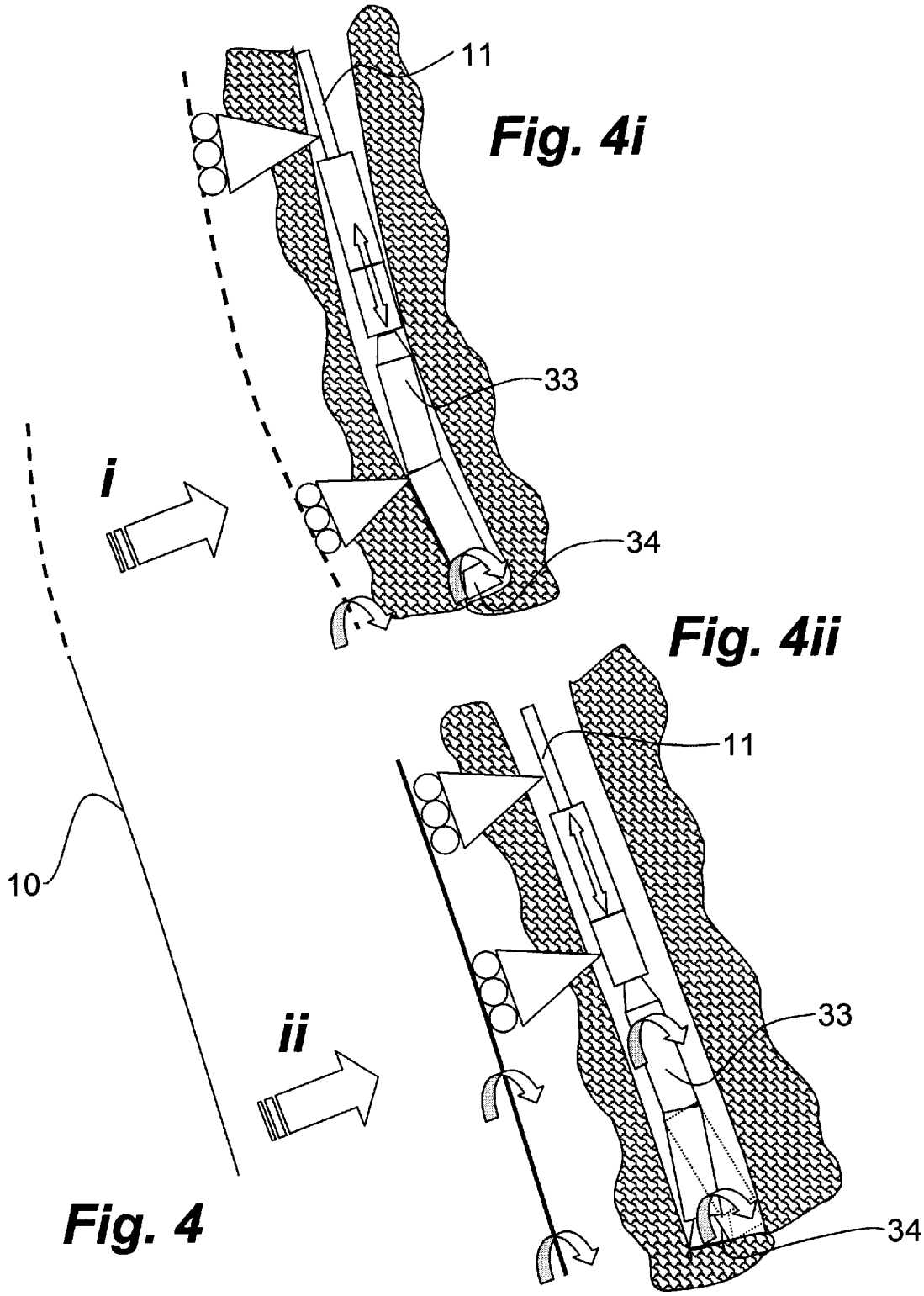
FIGS. 4–4*ii* illustrate in more detail implementation of an embodiment of the invention which results in the borehole path of FIG. 1*c*.

Turning to the present invention, and having reference to FIGS. 1*c*,4,4*i* and 4*ii*, a relatively continuous and gradual borehole 10 can also be achieved. A fanciful illustration of an embodiment of the apparatus is illustrated in FIGS. 4–4*ii*. As shown, in FIG. 4*i*, a sliding operation is characterized by non-rotating coiled tubing 11, a non-rotating bent housing 33 and a rotating bit 34. In the present invention shown in FIG. 4*ii*, in contradistinction to the prior art, rotating operation is now possible and is characterized by non-rotating coiled tubing 11, a rotating bent housing 33 and a rotating bit 34.

Depending upon the particular embodiment either, or both of, the drill bit 34 or the bent housing 33 can be rotationally driven with a motor. This description uses the term motor to include an electric motor or any drilling-fluid actuated motor or mud motor, examples of which are a positive displacement screw motor or a turbine. In the case of a turbine, which are often couple with higher speed-capable polycrystalline diamond compact (PDC) drill bits, the output rpm is generally higher than that provided by a screw-type motor. Accordingly, it Is understood in this specification that a turbine-type of motor may be specified to be additionally coupled with a gear-reducer so as to obtain a slower rpm for rotation of either the bent housing or the drill bit.

For rotating operation, and if both the first and second motors are mud motors, then drilling fluid is used to rotate both the bent housing and the drill bit simultaneously.

Figures 5A, 5B, 5C:
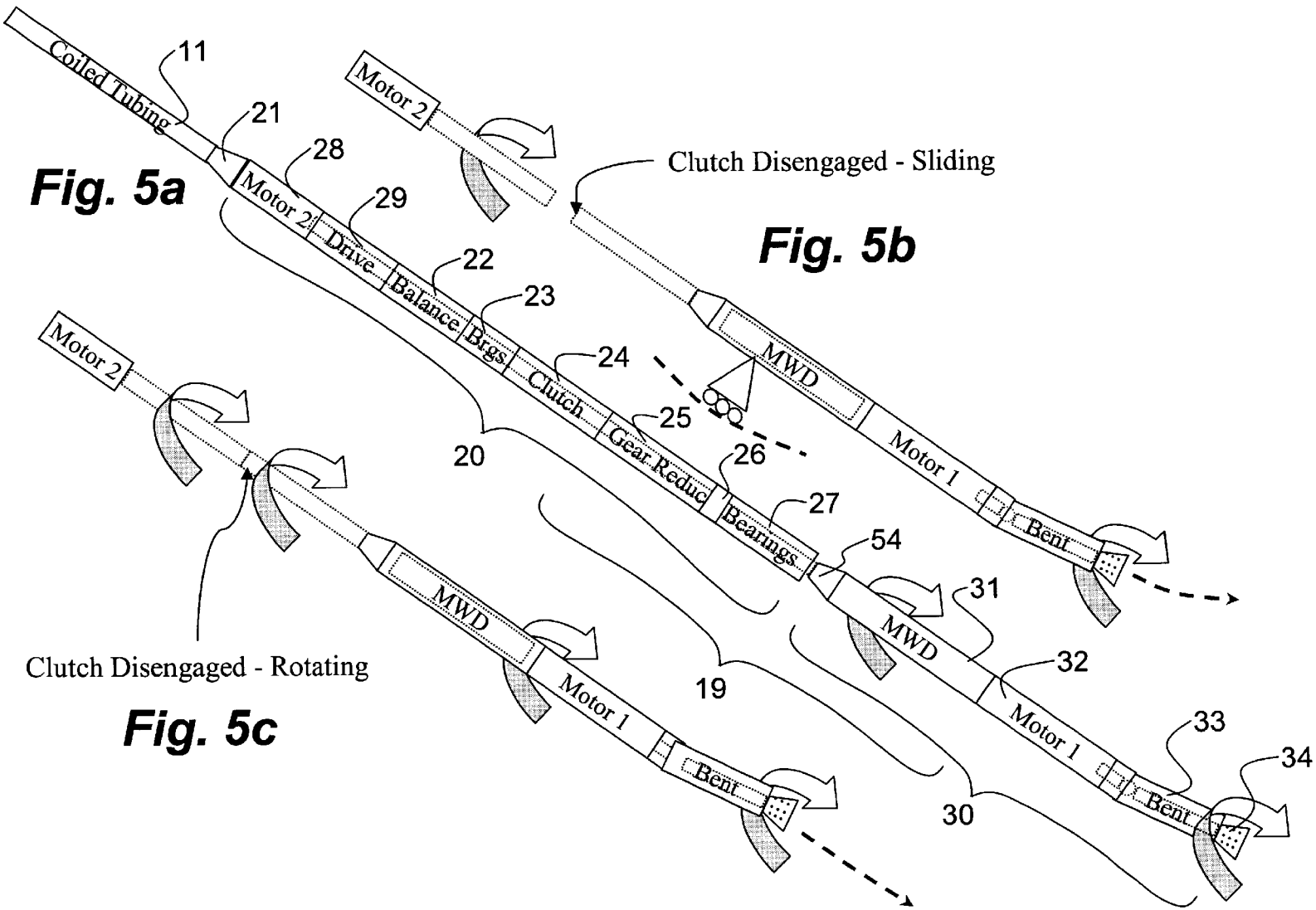
FIG. 5*a* is a simplified side view of a BHA according to the present invention.
FIG. 5*b* is a schematic partial view of the BHA of FIG. 5*a* where the clutch is engaged and the lower sub rotates.
FIG. 5*c* is a schematic partial view of the BHA of FIG. 5*a* where the clutch is disengaged and the lower sub is locked against rotation.

More particularly and having reference also to FIG. 5*a*, a bottom hole assembly (BHA) 19 is connected to the bottom of coiled tubing 11 which extends downhole through the borehole 10. The BHA 19 comprises an upper non-rotating sub 20 and a lower rotatable sub 30.

From the downhole end, the lower sub 30 comprises a bit 34, a bent housing 33 and a first motor 32. The type and rotational speed (rpm) of the first motor 32 is matched to the drill bit 34, be it a roller or a PDC type. A MWD tool 31 is also fitted to the lower sub 30 for determining the BHA's orientation. The lower sub 30 components can be of known and conventional configuration.

The novel upper sub 20 comprises a plurality of components including, from its uphole end, a coiled tubing connector 21 (typically including release and recovery components—not shown), a pressure-balancing sub 22, an upper bearing sub 23, a clutch assembly 24, a planetary speed reducer 25, a pressure reducing sub 26 and a lower bearing sub 27.

In a first embodiment, and having reference to FIGS. 5*a*, 6*a*–8*c*, the upper sub also includes a second motor 28 which, through the clutch assembly 24, is alternately disengaged or engaged for rotatably driving the lower sub 30. The type and rpm of the second motor 28 can be matched for achieving bent housing rotational speeds such as those typically used in conventional jointed tubing directional drilling.

When assembled, the components of the upper sub 20 form a continuous outer housing 40 and a contiguous bore 41. The contiguous bore 41 extends through to the lower sub 30 for conducting drilling fluids therethrough and to the drill bit 34.

Turning to the detail drawings, as shown in FIG. 6*a*, the illustrated second motor is, for this embodiment, a positive displacement, screw-type motor 28 comprising a stator 42, forming a portion of the outer housing 40, and a rotor 43.

A driveshaft 44 extends from the rotor 43 and downhole through the bore 41 of the outer housing 40 for forming a drilling fluid annulus 41*b* therebetween. The driveshaft 44 is connected to an upper hollow shaft 45. The driveshaft is fitted with constant velocity joints 44*a* at each end, to transmit the eccentric rotational action of the rotor to the centralized upper hollow shaft 45. Drilling fluid flows through annulus 41*b* and through crossover ports 46 and into the bore 41*c* of the upper hollow shaft 45.

Referring to FIG. 7*a*, a seal annulus 47 is formed between the outer housing 40 and the upper hollow shaft 45. An annular pressure-balancing piston 48 is located in the seal annulus 47. The balancing piston 48 separates drilling fluid in the uphole annulus 41*b* from clean lubricating oil downhole of the seal annulus 47. The lubricating fluid is distributed along the seal annulus 47, including through the clutch 24 and lower bearings 27. The upper hollow shaft 45 passes through upper radial thrust bearings 49. Upsets or shoulders 50 on the upper hollow shaft 45 bear against the bearings 49 which are supported at shoulders 51 formed on the outer housing 40. The bearings 49 center the upper hollow shaft 45 and resist thrust including downhole thrust from the second mud motor 28 and uphole thrust from weight on the drilling bit 34.

As shown in FIG. 7*b*, the lower end of the upper hollow shaft 45 terminates at an upper end of a lower input hollow shaft 52*a*. The upper and lower input hollow shafts 45,52*a* can be rotationally coupled through the clutch assembly 24. The clutch assembly 24 is described in greater detail in FIGS. 9–11.

As shown in FIGS. 8*a*–8*c*, the lower input hollow shaft 52*a*, extending downhole through the outer housing 40, is decoupled through the speed reducer 25 and continues through a slower-rotating lower output hollow shaft 52*b* which passes through radial bearings 53 and then continues through to the lower bearing sub 27 and to a lower sub connector 54. The speed reducer 25 is of conventional planetary gear design. In FIG. 8*b*, a pressure-reducing piston 55 equalizes the pressure of the lubricating fluids in the annulus 47. In FIG. 8*c*, radial thrust bearings 53 support the lower sub connector 54 as it extends through the outer housing 40.

Returning to FIGS. 5*a*–5*c*, but not detailed herein, the lower sub 30 is suspended from the lower sub connector 54. Accordingly, when the clutch 24 is engaged, the upper and lower hollow shafts 45,52*a*,52*b* co-rotate and rotate the lower bearing sub 30. Simply, when the lower sub 30 rotates, it emulates the rotating operation achieved with conventional jointed tubing directional drilling. The bent housing 33 rotates while the first motor 32 simultaneously continues to rotate the drill bit 34, providing rotating operation and thus achieving high ROP and a substantially linear borehole 10.

The ability to select sliding or rotating operation is achieved in part through the selectable rotation or locking of the lower sub 30 from the coiled tubing 11, the selection achieved through the clutch 24. The clutch 24 is located in the upper sub 20 in this embodiment.

In greater detail and having reference to FIGS. 7*b* and 9–11, the clutch assembly 24 comprises an annular clutch collar 100 which is axially movable on a spline 101 and which normally resides on the lower hollow shaft 52*b* when disengaged for sliding operation. The clutch 24 alternately engages and disengages the upper and lower hollow shafts 45,52*a*. At a lower end 102 of the upper hollow shaft 45 is a first transverse, toothed and co-rotating clutch face 103. A reciprocating and actuating mandrel 104, having an indexing barrel cam 105, uses differential fluid pressures between the pressure P2 of the fluid in the borehole 10 outside the outer housing 40 and the pressure P1 of the drilling fluid in the hollow shafts 45,52*a*, to actuate the clutch collar 100 between two axial positions. The barrel cam 105 is of conventional construction and has three positions. Two alternating axial uphole positions M3, M1 are enabled which respectively represent an engaged and disengaged clutch. An intermediate third position M2 represents the indexed cam shifting of the barrel cam 105 between the two other positions M3,M1. The basic structure of the barrel cam 105 is known to those of ordinary skill in the art, one example of which is provided in U.S. Pat. No. 5,311,952 to Eddison et al., the entire disclosure of which is incorporated herein by reference, (Eddison's FIGS. 2*b*,3) and thus detail is not provided. One approach to achieving both M1 and M3 positions is to add an uphole stop to alternating incremental cam paths (not shown).

The clutch collar 100 is fitted to a spline 101 at an upper end 107 of the lower hollow shaft 52*a*. The spline 107 enables axial movement of the collar 100 as it co-rotates with the lower hollow shaft 52*a*. A second transverse, toothed clutch face 108 is formed at the uphole end of the clutch collar 100 which is compatible with the first toothed clutch face 103. When engaged, the first and second toothed clutch faces 103,108 rotatably couple the upper and lower hollow shafts 45, 52*a* for co-rotation.

At the lower end of the collar 100 is formed a third transverse toothed clutch face 109. A fourth transverse toothed clutch face 110 is formed at a shoulder 111 formed on the outer housing 40. The fourth toothed clutch face 110 is compatible for coupling with the third toothed clutch face 109.

When the first and second clutch faces 103,108 are disengaged, the third and fourth clutch faces 109,110 are engaged for locking the lower sub 30 from reactive torque rotation so as to enable direction steering or sliding operation. Alternatively, when the first and second clutch faces 103,108 are engaged, the third and fourth clutch faces 109,110 are disengaged.

A mandrel annulus 112 is formed between the mandrel 104 and the outer housing 40 and is sealed from the lubrication fluids in the seal annulus 47 by a pair of upper and lower spaced mandrel seals 113*a*,113*b*. An annular mandrel spring 114 bears against an upper shoulder 115 and against a lower shoulder 116 on the mandrel 104 for biasing the mandrel 104 downhole. The seal annulus 47 bore is constricted forming the upper shoulder 115. The upper mandrel seal 113*a* separates the mandrel annulus 112 from the seal annulus 47 forming a small uphole piston face 117. The seal annulus 47 is enlarged and sealed with the lower seal 113*b* at the lower mandrel shoulder 116 to form a large downhole piston face 118. A pressure equalizing port 119 is formed between the mandrel annulus 112 and the borehole 10. The indexing barrel cam 105 is fitted to the lower end of the mandrel 104 and downhole from the lower seal 113*b*. One or more lugs 120 extend radially inwardly from the outer housing 40 to engage the barrel cam 105. As the mandrel 104 reciprocates axially up and down, the lugs 120 and barrel cam 105 cause an indexed and incremental angular rotation of the mandrel 104. At each indexed rotation, the mandrel is positioned between alternating axial uphole positions M3,M1. The mandrel 104 itself is not freely-rotating.

Axial movement of the mandrel 104 is effected through a combination of pressure differential P2,P1 and spring biasing.

The clutch collar 100 is axially manipulated between an uphole-located coiled collar spring 121 and the downhole-located actuating mandrel 104. The collar spring 121 biases the collar 100 downhole so as to disengage the first and second clutch faces 103,108 and to engage the third and fourth clutch faces 109,110.

The collar 100 and the mandrel 104 are alternately positioned in either an uphole or a downhole position. Further, the mandrel 104 has an intermediate standby position.

Figure 9:
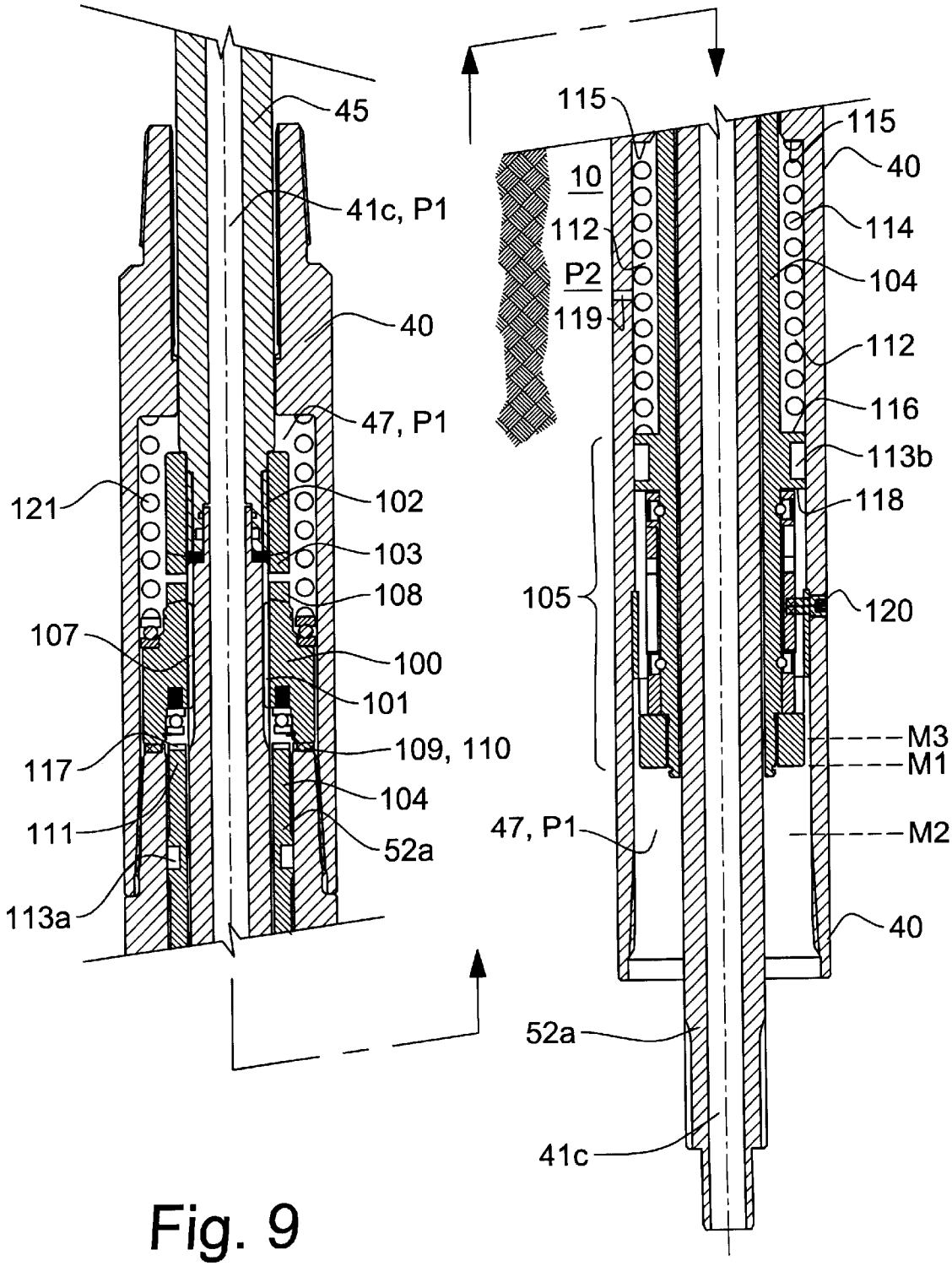
FIG. 9 is a cross-sectional view of the upper and lower hollow shafts and the clutch in sliding operation, with the mandrel disengaged, at full drilling fluid pressure.
Figure 10:
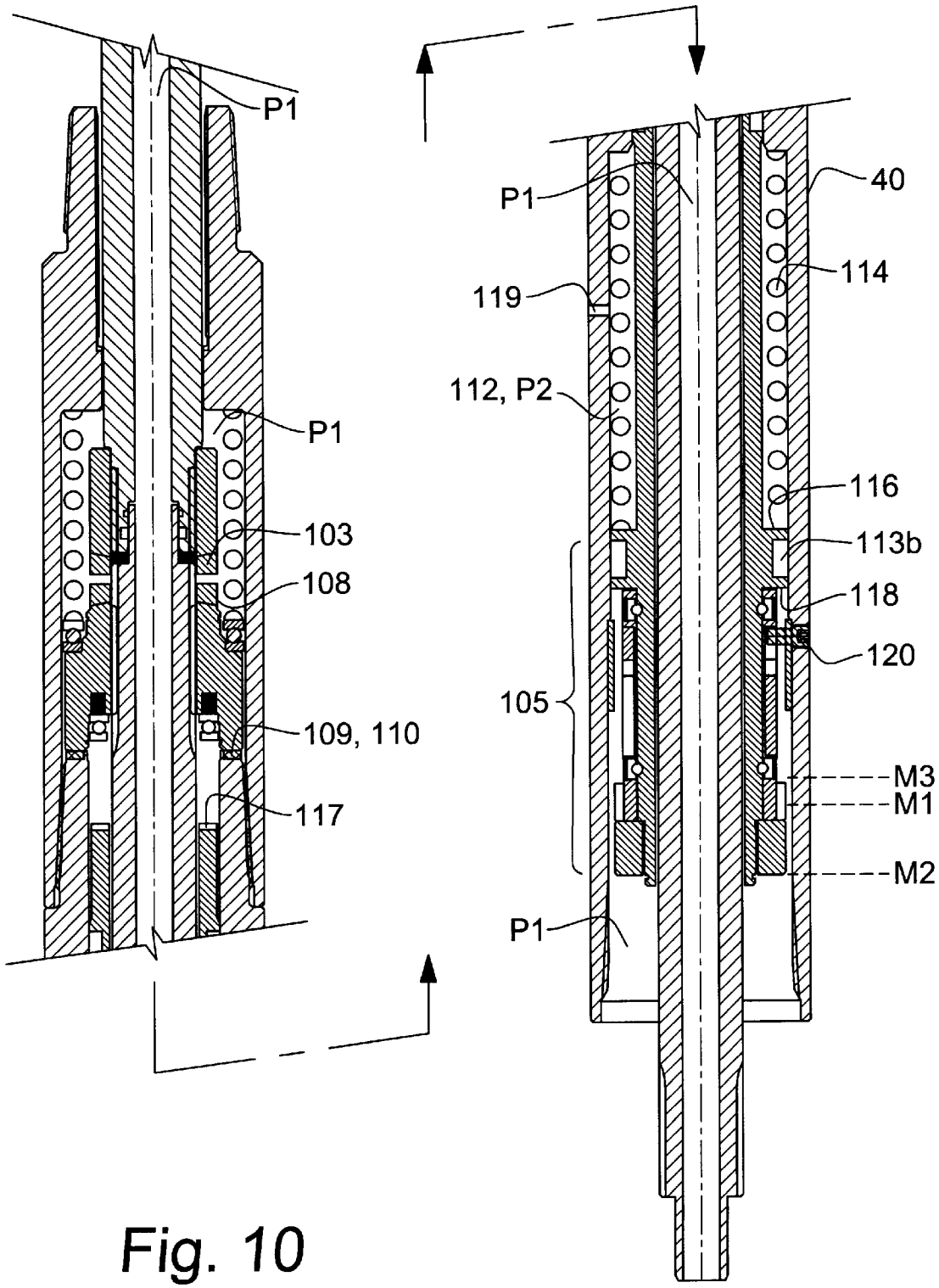
FIG. 10 is a cross-sectional view of the upper and lower hollow shafts and the clutch, with the mandrel disengaged, and where the drilling fluid pressure is reduced such that the barrel cam is being indexed to rotational operation.
Figure 11:
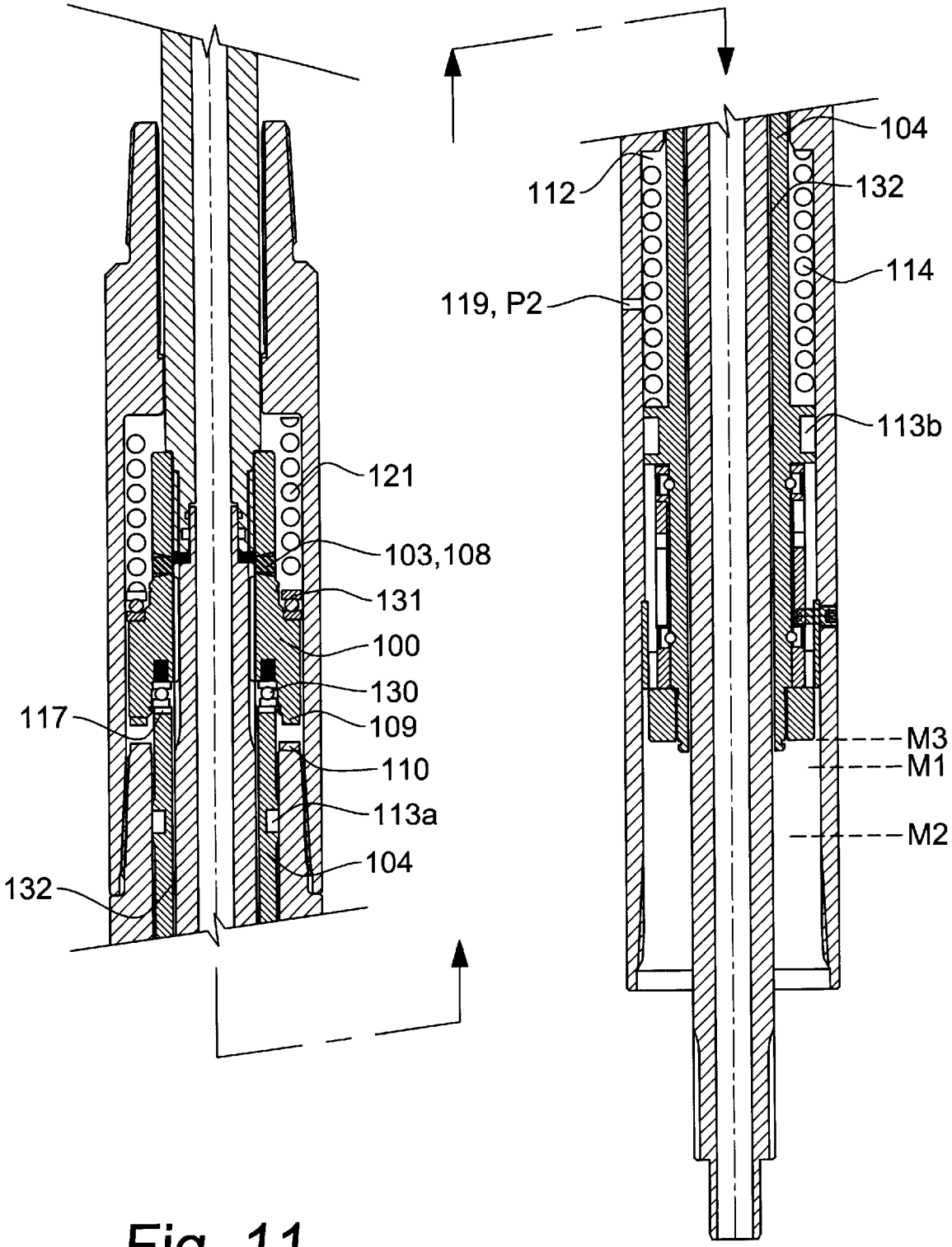
FIG. 11 is a cross-sectional view of the upper and lower hollow shafts and the clutch in rotational operation, with the mandrel engaged, at full drilling fluid pressure.

The operation of the clutch is illustrated in FIGS. 9–11. Sliding operation is show in FIG. 9. Rotating operation is shown in FIG. 11. Pressure shifting between sliding-to-rotating and between rotating-to-sliding operations is shown in FIG. 10.

Turning first to FIG. 9, in sliding operation, the barrel cam 105 is positioned low on the lugs 120 and the mandrel 104 is correspondingly in its downhole position M1, without supporting the collar at face 117. Un-contested, the collar spring 121 thrusts the collar 100 downhole and the third and fourth clutch faces 109, 110 engage, locking the lower hollow shaft 52*a* and the lower sub 30 against rotation. Each of the collar 100, the lower hollow shaft 52*a* and the lower sub 30 assume a non-rotating attitude with the outer housing 40.

Referring to FIG. 10, the barrel cam 105 is shifted to axially move the mandrel 104 for rotating operation from the sliding operation of FIG. 9. The shifting operation is detailed later.

Having reference to FIG. 11, for rotating operation, when the mandrel 104 is in its uphole position M3, the uphole piston face 117 engages the collar 100, thrusting it uphole and overcoming the resistance of the collar spring 121. The first and second clutch faces 103,108 engage and rotationally couple. A thrust bearing 130 positioned between the mandrel's non-rotating uphole piston face 117 and rotating collar 110 enables wear-free relative rotation therebetween. Similarly, a thrust bearing 131 positioned between the non-rotating collar spring 121 and rotating collar 100 provides wear-free relative rotation therebetween.

The axial shifting of the mandrel 104 between an uphole position M3 to a downhole position M1 and back again is achieved through pressure cycling. Having reference to FIG. 10, the mandrel 100 is shifted between uphole and downhole positions M3,M1 through cycling of the drilling fluid pressure P1; an actuating pressure threshold being sensitive to the spring constant of the annular mandrel spring 114. The mandrel operation is in accordance with the known principle that when the small uphole piston face 117 and the large downhole piston face 118 are subjected to the same pressure, the larger downhole piston exerts a greater net uphole force on the mandrel 104. This net uphole force is not resisted by an opposing pressure on the face of the large shoulder 116 due to the communication of the mandrel annulus 112 with the borehole pressure P2 through port 119.

Referring to FIG. 10, when the drilling fluid pressure P1 is greater than the borehole pressure P2, the balancing piston 48 (FIG. 7*a*) is driven downhole, pressurizing the lubrication fluid in the seal annulus 47 to balance the drilling fluid pressure P1. The lubrication fluid communicates with the clutch 24 and the uphole side of the small uphole piston face 117. The lubrication communicates with the clutch 24 through fluid passageways extending along the annular space 47 between the outer housing 40 and the first and second hollow shafts 52*a*,52*b*. The lubrication fluid further communicates with a downhole end of the mandrel 104 through an annular space 132 formed between the mandrel 104 and the lower hollow shaft 52*a*.

The mandrel annulus 112 communicates with the borehole 10 through port 119. Thus, when the drilling fluid pressure P1 is less than the borehole pressure P2, the pressure P2 in the mandrel annulus 112 is greater than the pressure P1 of the drilling fluid and thus also that of the lubrication fluid. Hence, the net force on the face 116 of the large downhole piston is downward, driving the mandrel 104 downhole.

Note that the clutch 24 is actuated through a pressure cycle, but the uphole or downhole status is dependent upon the incremental and serial positioning of the three-position M1,M2,M3 barrel cam 105. For instance, if a sliding operation was ongoing (FIG. 9) the mandrel's barrel cam 105 is normally positioned at M1 on the lugs 120, the mandrel 104 is in a neutral position, and the clutch collar 100 is disengaged. Upon a decrease of the drilling fluid pressure P1, the mandrel 104 is driven further downhole to M2 by the shifted differential pressure and the annular mandrel spring 114, and the barrel cam 105 incrementally rotates. Upon a re-pressurization of the drilling fluid P1, the mandrel 104 is driven uphole to M3 to engage the collar 100, overcoming the collar spring 121 and engaging the clutch 24 for rotation of the lower sub 30 by the second mud motor 28.

Upon a subsequent decrease of the drilling fluid pressure P1, the mandrel 104 is again driven further downhole to M2 by the pressure differential and the mandrel spring 114. The barrel cam 105 incrementally rotates the mandrel 104 to the sliding operation mode. Upon a re-pressurization of the drilling fluid P1, the mandrel 104 is again driven uphole to M1 where the barrel cam 105 engages a stop (not shown) which limits the uphole travel, short of engaging the collar 100. Thus, the collar 100 is disengaged from the second motor 28 and becomes engaged with the outer housing 40 so as to lock the lower sub 30 from free-rotation.

In a second embodiment, one can omit the second motor 28 and driveshaft 29,44. The upper hollow shaft 45 and speed reducer 25 are retained. Accordingly, for rotating operation, the clutch 24 is engaged and the drill bit 34 is rotated to engage the borehole 10, wherein a reactive torque is transferred to the lower sub 30 through the connection of the first motor 32 to the lower sub 30. The lower sub 30 rotates in the opposite direction to the drill bit 34. The lower sub rotates the lower sub connector 54. To avoid transferring all the first motor torque into rotation of the lower sub 30 and thus defeat the drilling process, a high ratio speed reducer 25 is chosen. The speed reducer 25 is located between the non-rotating upper sub 20 and the rotating lower sub 30. The rotating lower sub connector 54, being connected to the low speed output shaft (such as through the lower output hollow shaft 52*b*) attempts to rotate the high speed input shaft (such as the lower input hollow shaft 52*a* and upper hollow shaft 45) at high speed, effectively transferring the majority of the torque into the drill bit 34, with only some torque being expended to rotate the lower sub 30, for rotating operation.

Figure 12A:
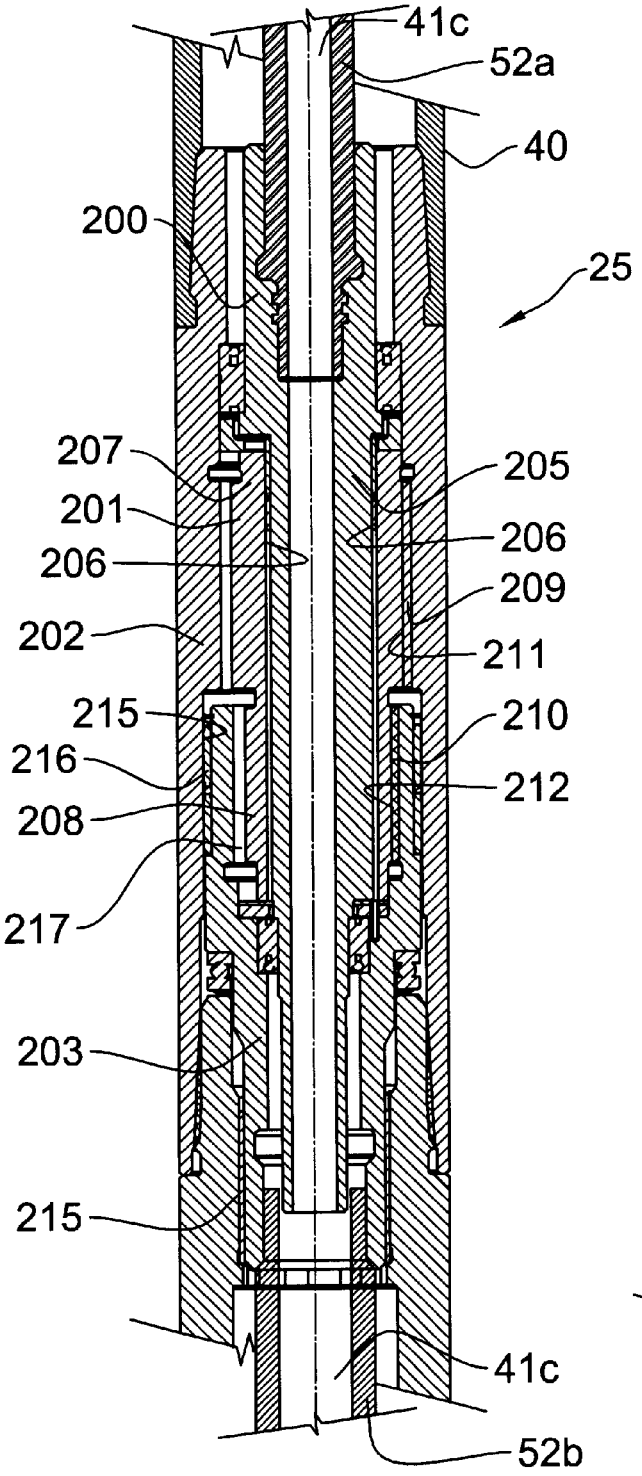
FIG. 12*a* is a cross-sectional view of a high reduction speed reducer according to the second embodiment of the invention.
Figure 12B:
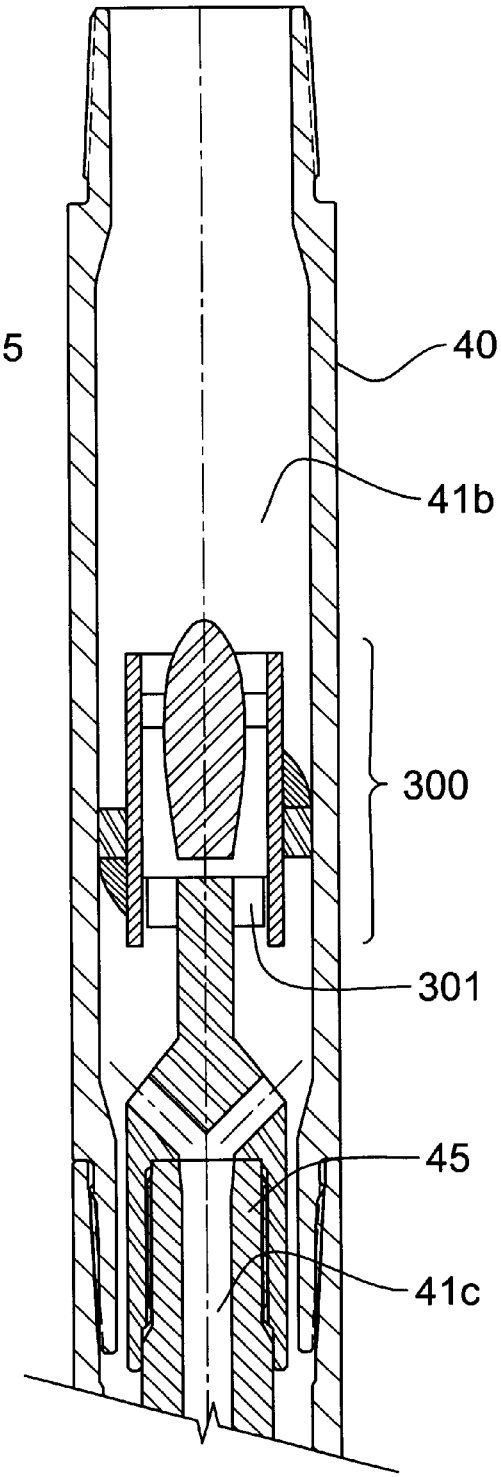
FIG. 12*b* is a cross-sectional view of the housing according to FIG. 6*b*, less the driveshaft and including a flowmeter according to the second embodiment of the invention.

The speed reducer's high speed input, such as hollow shafts 52*a*,45 can be coupled to an energy dissipation device 300 for controlling the torque distribution (FIG. 12*b*). For returning to sliding operation, the clutch 24 is disengaged, locking the lower sub 30 to the upper sub 20. In FIGS. 5*a*–5*c*, the illustrated first embodiment can represent the second embodiment by replacement of the motor 28 and driveshaft 29 with the energy dissipation device 300.

In FIG. 12*a*, one form of speed reducer 25 is illustrated which is well-suited to implementation in the second embodiment. The principles of such a reducer are disclosed in U.S. Pat. No. 4,760,759 to Blake, the entirety of which is incorporated herein by reference. The speed reducer 25 is an in-line gear reducer capable of high reduction rates, in the order of 100:1.

Specifically, the speed reducer 25 comprises an input shaft 200, a floating pinion 201, a supporting tubular housing 202, and an output shaft 203. The input and output shafts 200,203 co-rotate at different speeds. Conventionally, the input shaft 200 is the high speed shaft and the output shaft 203 is the low speed shaft. The input shaft 200 is concentrically and rotatably supported in the tubular housing 202. The input shaft 200 has an eccentric outer shaft portion 205. The floating pinion 201 has an inner bore 206 fitted with needle bearings for rotation about the eccentric outer shaft portion 205. The pinion 201 therefore rotates eccentrically about the axis of the tubular housing 202. The pinion 201 has a large end 207 axially spaced from a small end 208. Each end 207,208 is fitted with a gear face 209,210. The pinion's large end gear face 209 engages a corresponding ring gear 211 in the tubular housing 202. The housing's ring gear 211 has a larger pitch diameter than the pinion's gear face 209. As the input shaft 200 rotates, the pinion's large end gear face 209 meshes with the housing gear face 211, causing the pinion 201 to contra-rotate about the input shaft 200.

The output shaft 203 is concentrically and rotatably supported in the tubular housing 202. Bearings 215 are fitted into an annulus 216 between the output shaft 203 and the tubular housing 202. The annulus 216 is small and needle bearings 215 are fitted therein. The output shaft 203 has an eccentric bore portion 217 fitted with a small ring gear 212 which axially engages the pinion's eccentric outer small end gear face 210. The eccentric rotation of the pinion 201 causes the output shaft 203 to contra-rotate relative to the pinion 201 and rotate in the same direction as the input shaft 200. The difference in the number of teeth in each gear set 209,211 and 210,212 determines the amount of reduction that can be achieved.

High reduction rates (100:1) can be achieved in a small tubular assembly with the added advantage of the output shaft 203 turning in the same direction as the input shaft 201. An advantage of positioning the clutch assembly 24 on the high speed side of the speed reducer 25 is a reduced torque duty.

As stated above, the rotating lower sub connector 54 is connected to the low speed output shaft 203, through lower hollow output shaft 52*b*, so that the lower sub 30 is capable of only slowly contra-rotating as the drill bit 34 rotates.

The energy dissipation device 300 is driven by the input shaft 200 of the speed reducer 25, preferably at the upper shaft 45. One such device 300 includes a viscous drag device such as a flow counter or flowmeter having some form of turbine rotor 301. The flowmeter has known revolutions per unit flow of mud pumped therethrough, such as 1 revolution per US gal of mud. Accordingly, rotation of the high speed input shaft 200 is substantially limited by the mud flow rate therethrough, enabling control of the lower sub's contra-rotation merely by varying the rate of mud flow. The turbine rotor 301 of a flowmeter can be driven by the high speed input shaft to provide the appropriate drag.

Performance of a flowmeter can be sensed remotely, whether by electronic or fluid pulse, which enables remote monitoring and manipulation of the rotating operations. A variety of suitable flowmeters are known including those disclosed in U.S. Pat. Nos. 5,831,177 and 5,636,178, both to Halliburton of Houston Tex.

The advantages of the present invention include the ability to practice both rotating and sliding operations in coiled tubing directional drilling while being able to monitor and control the speed of contra-rotation of the bend sub.

The embodiments of the invention in which an exclusive property or privilege is claimed are defined as follows:

1. Apparatus for directional drilling with colled tubing comprising:

an uphole sub connected to the coiled tubing;

a downhole sub having a bent housing, a drill bit and a first motor for rotating the drill bit to form the borehole, a rotary connection between the uphole sub and the downhole sub for enabling rotation therebetween; and a clutch positioned between the rotary connection and the uphole sub and operable between engaged and disengaged positions using fluid cycles applied alternately to engage the clutch and to disengage the clutch, a fluid cycle comprising a substantial change in pressure of the drilling fluid:

wherein the clutch further comprises:

an input shaft and co-rotating first clutch face;

an output shaft and co-rotating second clutch face formed on a collar which reciprocates axially thereon the output shaft being connected for co-rotation with the lower sub;

a third clutch face formed on the collar and a fourth clutch face formed on the uphole sub so that i. when the clutch is disengaged, the collar is reciprocated axially to a first position to disengage the first and second clutch faces to disengage as second motor from the bent housing and engage the third and fourth clutch faces for locking rotation between the output shaft and the uphole sub, and ii. when the clutch is engaged, the collar is reciprocated axially to a second position to engage the first and second clutch faces so that when engaged the second motor causes the input shaft and the output shaft to co-rotate for rotating the lower sub, and disengage the third and fourth clutch faces.

2. Apparatus for directional drilling with coiled tubing comprising:

an uphole sub connected to the coiled tubing;

a downhole sub having a bent housing and a drill bit, rotation of the drill bit forming a borehole;

a rotary connection between the uphole sub and the downhole sub for enabling rotation therebetween; and a clutch positioned between the rotary connection and the uphole sub and operable between engaged and disengaged positions using fluid cycles applied alternately to engage the clutch and to disengage the clutch, a fluid cycle comprising a substantial change in pressure of the drilling fluid, so that when the clutch is disengaged, the bent housing is locked against rotation and when the clutch is engaged, the bent housing is rotatable.

a speed reducer between the rotary connection and the uphole sub and having a low speed output connected to the rotary connection;

a first motor mounted in the downhole sub and which rotates the drill bit, reactive torque from the drill bit being transmitted into the downhole sub so that when the clutch is engaged, the reactive torque causes the downhole sub and bent housing to rotate opposite to the drill bit and the speed reducer dissipates torque so as to retard free rotation of the downhole sub; and means driven by a high speed input for dissipating torque at the speed reducer.

3. The apparatus of claim 2 further comprising a flowmeter driven by the high speed input for dissipating torque at the speed reducer.

4. Apparatus for directional drilling with coiled tubing comprising:

an uphole sub connected to the coiled tubing;

a downhole sub having a bent housing and a drill bit, rotation of the drill bit forming a borehole;

a rotary connection between the uphole sub and the downhold sub for enabling rotation therebetween;

a clutch positioned between the rotary connection and the uphole sub and operable between engaged and disengaged positions using fluid cycles applied alternately to engage the clutch and to disengage the clutch, a fluid cycle comprising a substantial change in pressure of the drilling fluid;

a speed reducer between the rotary connection and the uphole sub and having a low speed output connected to the rotary connection;

a first motor mounted in the downhole sub and which rotates the drill bit, reactive torque from the drill bit being transmitted into the downhole sub so that when the clutch is engaged, the reactive torque causes the downhole sub and bent housing to rotate opposite to the drill bit and the speed reducer dissipates torque so as to retard free rotation of the downhole sub.

wherein the clutch further comprises:

an input shaft and co-rotating first clutch face;

an output shaft and co-rotating second clutch face formed on a collar which reciprocates axially thereon, the output shaft being connected for co-rotation with the lower sub;

a third clutch face formed on the collar; and a fourth clutch face formed on the uphole sub an axially reciprocating mandrel, one end of which alternately engages and disengages the collar;

a piston for reciprocating the mandrel in response to pressure changes in the drilling fluid; and a barrel cam formed on the mandrel which indexes the mandrel between its first and second position so that i. when the clutch is disengaged, the collar is reciprocated axially to a first position to disengage the first and second clutch faces and lock the bent housing against rotation and engage the third and fourth clutch faces for locking rotation between the output shaft and the uphole sub, and ii. when the clutch is engaged, the collar is reciprocated axially to a second position to engage the first and second clutch faces so as permit the bent housing to rotate for co-rotating the downhole sub and disengage the third and fourth clutch faces.

5. Apparatus for directional drilling with coiled tubing comprising:

an uphole sub connected to the coiled tubing;

a downhole sub having a bent housing and a drill bit, rotation of the drill bit forming a borehole;

a rotary connection between the uphole sub and the downhole sub for enabling continuous rotation;

a clutch positioned between the rotary connection and the uphole sub for alternately locking the bent housing against rotation and freeing the bent housing for rotation;

a speed reducer positioned between the coiled tubing and the bent housing and having a high speed shaft and a low speed shaft, the low speed shaft being connected to the bent housing so that when the bent housing is free for rotation, reactive torque from the rotary drill bit causes the bent housing to contra-rotate at a speed less than that of the rotary drill bit; and means driven by the high speed shaft for dissipating torque at the speed reducer.

6. The apparatus of claim 5 further comprising a flowmeter driven by the high speed shaft for dissipating torque at the speed reducer.

7. The apparatus of claim 5 wherein the high speed shaft is fluidly coupled to the drilling fluid for resisting rotation.

8. A method for directional drilling in a borehole with coiled tubing having a bent housing and rotary drill bit connected thereto, the method comprising:

providing a speed reducer having a low speed output connected to an upper end of a clutch and a rotary connection between a lower end of the clutch and the bent housing, the clutch operable between engaged and disengaged positions through cycling of drilling fluid flow through the coiled tubing;

orienting the bent sub by engaging the clutch for coupling of the speed reducer to the rotating connection, orienting the bent sub in the borehole by rotating the drill bit, reactive torque causing bent sub and rotating connection to contra-rotate and drive the speed reducer through the clutch;

drilling a borehole in a sliding operation by disengaging the clutch for decoupling the speed reducer from the rotating connection and for locking the rotating connection to the coiled tubing, then drilling with the drill bit;

drilling a borehole in a rotating operation by engaging the clutch for coupling of the speed reducer to the rotating connection and releasing the rotating connection from the coiled tubing, then drilling with the drill bit wherein reactive torque causes the bent sub and rotating connection to contra-rotate simultaneously; and dissipating torque at the speed reducer by driving an energy dissipating device.

9. The method of claim 8 wherein torque is dissipated by driving a viscous device.

10. The method of claim 8 wherein torque is dissipated by driving a flowmeter.

11. A method for directional drilling in a borehole with coiled tubing having a bent housing and rotary drill bit connected thereto, the method comprising:

in a sliding operation, orienting a bent housing by engaging a clutch to couple the bent housing through a rotary connection at the coiled tubing to a speed reducer, drilling with the rotary bit wherein reactive torque causes the bent sub to contra-rotate at the rotary connection, and once oriented, disengaging the clutch for disengaging the speed reducer and for locking the bent housing against relative rotation to the coiled tubing, and drilling with the rotary bit;

in a rotating operation, engaging the clutch to unlock the bent housing from the coiled tubing and for coupling the bent housing to the speed reducer, and then drilling with the rotary drill bit wherein reactive torque causes the bent sub to contra-rotate; and dissipating torque at the speed reducer by driving an energy dissipating device.

12. The method of claim 11 wherein torque is dissipated by driving a viscous device.

13. The method of claim 11 wherein torque is dissipated by driving a flowmeter.

14. The method of claim 13 further comprising the step of controlling the speed of contra-rotation of the bent sub by adjusting the flow of drilling fluid through the flowmeter.

15. A method of directional drilling with coiled tubing comprising the steps of:

providing a bottom hole assembly at a down hole end of the non-rotating coiled tubing, the bottom hole, assembly comprising an uphole sub having a clutch and a rotating connection, and a downhole sub connected to the upper sub's rotating connection, the downhole sub having a bent housing and a rotary drill bit;

orienting the bent housing by engaging the clutch for unlocking the rotating connection for coupling a motor and a speed reducer with the downhole sub for rotation of the downhole sub to the desired orientation;

performing sliding drilling operation by disengaging the clutch for locking the rotating connection and drilling a curved borehole with the rotary bit;

performing rotating drilling operation by engaging the clutch for unlocking the rotating connection for rotation of the downhole sub drilling with the rotary bit while the downhole sub rotates at the rotating connection for drilling a substantially straight borehole; and dissipating torque at the speed reducer by driving an energy dissipating device.

16. The method of claim 15 wherein torque is dissipated by driving a viscous device.

17. The method of claim 15 wherein torque is dissipated by driving a flowmeter.

* * * * *